US011180721B2

(12) United States Patent
Crossman et al.

(10) Patent No.: US 11,180,721 B2
(45) **Date of Patent: *Nov. 23, 2021**

(54) ANCILLARY LAUNDRY COMPOSITION

(71) Applicant: Conopco, Inc., Englewood Cliffs, NJ (US)

(72) Inventors: Martin Charles Crossman, Merseyside (GB); Andrew David Green, Merseyside (GB); Jonathan Osler, Merseyside (GB); Geraint Paul Roberts, Cheshire (GB); Adrian Kevin Norman Williams, Merseyside (GB)

(73) Assignee: Conopco, Inc., Englewood Cliffs, NJ (US)

( * ) Notice: Subject to any disclaimer, the term of this patent is extended or adjusted under 35 U.S.C. 154(b) by 62 days.

This patent is subject to a terminal disclaimer.

(21) Appl. No.: 16/485,274

(22) PCT Filed: Jan. 24, 2018

(86) PCT No.: PCT/EP2018/051672

§ 371 (c)(1),
(2) Date: Aug. 12, 2019

(87) PCT Pub. No.: WO2018/145895

PCT Pub. Date: Aug. 16, 2018

(65) Prior Publication Data

US 2020/0056128 A1 Feb. 20, 2020

(30) Foreign Application Priority Data

Feb. 13, 2017 (EP) ..... 17155681
Feb. 13, 2017 (EP) ..... 17155836

(51) Int. Cl.

| | |
|---|---|
| ***C11D 3/37*** | (2006.01) |
| ***C11D 11/00*** | (2006.01) |
| ***C11D 3/00*** | (2006.01) |
| ***C11D 3/22*** | (2006.01) |
| ***C11D 3/50*** | (2006.01) |
| ***C11D 17/00*** | (2006.01) |

(52) U.S. Cl.

CPC ..... *C11D 11/0017* (2013.01); *C11D 3/0015* (2013.01); *C11D 3/227* (2013.01); *C11D 3/3742* (2013.01); *C11D 3/505* (2013.01); *C11D 17/0017* (2013.01)

(58) Field of Classification Search

CPC ... C11D 11/0017; C11D 3/227; C11D 3/0015; C11D 1/62; C11D 3/001; C11D 3/373

See application file for complete search history.

(56) References Cited

U.S. PATENT DOCUMENTS

| | | | |
|---|---|---|---|
| 5,752,981 | A | 5/1998 | Fornelli |
| 6,240,953 | B1 | 6/2001 | Laughlin |
| 6,251,850 | B1 | 6/2001 | Clarke et al. |
| 6,750,191 | B2 | 6/2004 | Kasturi |
| 6,949,498 | B2 | 9/2005 | Murphy et al. |
| 7,407,293 | B2 | 8/2008 | Ishii |
| 8,304,375 | B1 | 6/2012 | Wolff et al. |
| 2002/0019328 | A1 | 2/2002 | Schroeder et al. |
| 2002/0037823 | A1 | 3/2002 | Honma et al. |
| 2002/0077265 | A1 | 6/2002 | Buzzacarini et al. |
| 2002/0128170 | A1 | 9/2002 | DeClercq et al. |
| 2003/0104969 | A1 | 6/2003 | Caswell et al. |
| 2003/0220217 | A1 | 11/2003 | McHattie |
| 2004/0016060 | A1 | 1/2004 | Detering et al. |
| 2004/0033924 | A1 | 2/2004 | Murphy et al. |
| 2004/0058845 | A1 | 3/2004 | Metrot et al. |
| 2004/0092425 | A1 | 5/2004 | Boutique et al. |
| 2004/0103483 | A1 | 6/2004 | Delplancke et al. |
| 2004/0107506 | A1 | 6/2004 | Detering et al. |
| 2004/0121929 | A1 | 6/2004 | Wang et al. |
| 2004/0139559 | A1 | 7/2004 | Detering et al. |
| 2005/0250668 | A1 | 11/2005 | Serobian et al. |
| 2006/0122088 | A1 | 6/2006 | Sadlowski et al. |
| 2007/0105739 | A1 | 5/2007 | Wahl et al. |
| 2007/0111914 | A1 | 5/2007 | Hsu et al. |
| 2007/0128142 | A1 | 6/2007 | Harrison et al. |
| 2007/0163055 | A1 | 7/2007 | Delplancke et al. |
| 2008/0009432 | A1 | 1/2008 | Caswell et al. |
| 2009/0036346 | A1 | 2/2009 | Bird et al. |
| 2009/0069522 | A1 | 3/2009 | Hessefort et al. |
| 2009/0186798 | A1 | 7/2009 | Baston et al. |
| 2010/0325812 | A1 | 12/2010 | Panandiker et al. |
| 2010/0331229 | A1 | 12/2010 | Bianchetti et al. |
| 2011/0039753 | A1 | 2/2011 | Cauvin et al. |
| 2011/0111999 | A1 | 5/2011 | Smets et al. |
| 2011/0209291 | A1 | 9/2011 | Sadlowski et al. |

(Continued)

FOREIGN PATENT DOCUMENTS

| | | |
|---|---|---|
| CN | 1332787 | 10/1999 |
| CN | 1277836 | 12/2000 |

(Continued)

OTHER PUBLICATIONS

IPRP2 in PCTEP2018053305; dated Jun. 4, 2019.
Written Opinion 2 in PCTEP2018053305.
S. Ugazio et al.; New Method for Direct Incorporation and Stabilization of Silicone Polymers in Fabric Softeners; SOFW Journal; 2007; pp. 48, 50-52, 54; XP001540614; vol. 133.
Search Report and Written Opinion in EP17155861; dated Aug. 4, 2017.
Search Report and Written Opinion in EP17155838; dated Aug. 2, 2017.
Search Report and Written Opinion in EP17155805; dated Jul. 27, 2017.

(Continued)

*Primary Examiner* — John R Hardee
(74) *Attorney, Agent, or Firm* — Greenberg Traurig, LLP

(57) ABSTRACT

An ancillary laundry composition comprising: a) 2-20 w.t. % functionalised fabric softening silicone; b) Less than 5 w.t. % surfactant; c) 0.35-10 w.t. % cationic cellulose polymer d) Water 10 wherein the functionalised fabric softening polymer and cationic cellulose polymer are present in a ratio of 5:2 to 1:6 by weight.

11 Claims, No Drawings

(56) References Cited

U.S. PATENT DOCUMENTS

| | | | |
|---|---|---|---|
| 2011/0240065 | A1 | 10/2011 | Panandiker et al. |
| 2011/0277248 | A1 | 11/2011 | Panandiker et al. |
| 2012/0004156 | A1 | 1/2012 | Panandiker et al. |
| 2012/0071382 | A1 | 3/2012 | Wang et al. |
| 2012/0309663 | A1 | 12/2012 | Panandiker et al. |
| 2013/0232700 | A1 | 9/2013 | Smith et al. |
| 2014/0023609 | A1 | 1/2014 | Mukherjee et al. |
| 2014/0369943 | A1 | 12/2014 | Pilz et al. |
| 2015/0030643 | A1 | 1/2015 | Gartstein et al. |
| 2015/0197708 | A1 | 7/2015 | Jin |
| 2015/0330020 | A1 | 11/2015 | van Buskirk et al. |
| 2016/0024435 | A1 | 1/2016 | Vetter et al. |
| 2016/0060574 | A1 | 3/2016 | Panandiker |
| 2016/0060575 | A1 | 3/2016 | Panandiker |
| 2016/0168508 | A1 | 6/2016 | Ribaut et al. |
| 2016/0296459 | A1 | 10/2016 | Sun et al. |
| 2016/0348042 | A1 | 12/2016 | Schmiedel |
| 2017/0335245 | A1 | 11/2017 | Burgess |

FOREIGN PATENT DOCUMENTS

| | | | |
|---|---|---|---|
| CN | 1646760 | | 7/2005 |
| CN | 101657530 | | 2/2010 |
| CN | 103668989 | | 3/2014 |
| CN | 103695195 | | 4/2014 |
| CN | 104060472 | | 9/2014 |
| CN | 104487559 | | 4/2015 |
| CN | 104781381 | | 7/2015 |
| CN | 105155257 | | 12/2015 |
| CN | 105421080 | | 3/2016 |
| CN | 205653653 | | 10/2016 |
| CN | 106148006 | | 11/2016 |
| CN | 110291180 | | 9/2019 |
| EP | 1080714 | | 3/2001 |
| EP | 3580319 | | 11/2020 |
| JP | 10001874 | | 1/1998 |
| JP | 2000129577 | A | 5/2000 |
| KR | 101423649 | | 7/2014 |
| WO | WO9839401 | | 9/1998 |
| WO | WO2000024856 | | 5/2000 |
| WO | WO2005079621 | A | 9/2005 |
| WO | WO2006088980 | | 8/2006 |
| WO | WO2008120176 | | 10/2008 |
| WO | WO2010120863 | | 10/2010 |
| WO | WO2013189010 | | 12/2013 |
| WO | WO2014079621 | | 5/2014 |
| WO | WO2015078692 | | 6/2015 |
| WO | WO2015078766 | | 6/2015 |
| WO | WO2018145896 | | 8/2018 |
| WO | WO2018145897 | | 8/2018 |

OTHER PUBLICATIONS

Search Report and Written Opinion in EP17155812; dated Jul. 3, 2017.
Search Report and Written Opinion in EP17155863; dated Jun. 27, 2017.
Search Report and Written Opinion in EP17155804; dated May 11, 2017.
Search Report and Written Opinion in PCTEP2018051673; dated Mar. 5, 2018.
Anonymous; Viscosity Tables; V&P Scientific Inc Internet article; 2010; pp. 1-4; XP055453259; www.vp-sci.com.
Search Report and Written Opinion in PCTEP2018053305; dated Mar. 27, 2018.
Search Report and Written Opinion in PCTEP2018053030; dated Apr. 24, 2018.
Search Report and Written Opinion in PCTEP2018053289.
Search Report and Written Opinion in EP17155836; dated Aug. 2, 2017.
IPRP2 in PCTEP2018051675; dated May 17, 2019.
Search Report and Written Opinion in PCTEp2018051674; dated Apr. 20, 2018.
Search Report and Written Opinion in PCTEP2018051675.
Written Opinion 2 in PCTEP2018051674; dated Jan. 16, 2019.
Written Opinion in PTEP2018051675; dated Jan. 22, 2019.
Search Report and Written Opinion in PCTEP2018051672; dated Apr. 23, 2018.
Written Opinion 2 in PCTEP2018053030; dated Jan. 14, 2019.
Written Opinion 2 in PCTEP2018051672; dated Jan. 17, 2019.
IPRP2; dated May 9, 2019.
Svensson et al., Surface Deposition and Phase Behavior of Oppositely Charged Polyion-Surfactant Ion Complexes, 2, A Means to Deliver Silicone Oil to Hydrophilic Surfaces: ACS Applied Materials & Interfaces: Jan. 27, 2010: XP055369144, pp. 143-156; vol. 2. No. 1.

ANCILLARY LAUNDRY COMPOSITION

FIELD OF THE INVENTION

The present invention relates to ancillary laundry compositions providing improved softening to fabrics. In particular ancillary laundry compositions comprising silicones and low levels of surfactant

BACKGROUND OF THE INVENTION

Textile fabrics, including clothes can often feel harsh after the laundry process. To reduce the harshness experienced after multiple wash cycles, technologies have been developed to increase the softness of fabrics post wash. These technologies include fabric conditioner compositions and softening systems added to detergent compositions.

WO 2014/079621 discloses a laundry detergent composition comprising: surfactant, fabric softening silicone and cationic polysaccharide polymer.

However there is a need to improve the softness benefit provided. Unilever co-pending application there is disclosed a fabric softening ancillary laundry composition, with improved softening. However due to the high levels of silicones and cationic polymers, in some cases a stabiliser is required. It has surprisingly been found that a particular class or fabric softening silicone and particular class of cationic polymer, used at the correct ratio, provide a stable ancillary laundry composition, without the requirement for a stabiliser.

SUMMARY OF THE INVENTION

In a first aspect of the present invention is an ancillary laundry composition comprising:

a) 2-60 w.t. % functionalised fabric softening silicone;

b) Less than 5 w.t. % surfactant;

c) 0.25-10 w.t. % cationic cellulose polymer d) Water wherein the functionalised fabric softening polymer and cationic cellulose polymer are present in a ratio of 5:2 to 1:6 by weight.

In a second aspect of the present invention is a method of laundering fabrics, wherein the fabrics are treated with a laundry detergent composition and an ancillary laundry composition comprising:

a) 2 to 60 w.t. % fabric softening silicone;

b) 0 to 5 w.t. % surfactant;

c) 0.25-20 w.t. % cationic cellulose polymer;

d) Water.

In a third aspect of the present invention is provided a use of the ancillary laundry composition disclosed herein to enhance the softening provided by silicone to a fabric

DETAILED DESCRIPTION OF THE INVENTION

Product Form

The present invention is concerned with ancillary laundry compositions. These are compositions intended to be used in addition to the consumer's regular laundry products. For example in addition to a wash detergent and/or rinse added fabric conditioners. However consumers may choose to use the product in anyway. The ancillary laundry composition may be added into that wash liquor at any point in the wash cycle.

Functionalised Fabric Softening Silicone

Silicones and their chemistry are described in, for example in The Encyclopaedia of Polymer Science, volume 11, p 765.

Silicones suitable for the present invention are functionalised fabric softening silicones. A functionalised silicone, is a silicone chain onto which has been added a functional group. PDMS is not a functionalised silicone.

Non-limiting examples of such functionalised silicones include: alkyl (or alkoxy) functionalised silicones, and functionalised silicones or copolymers with one or more different types of functional groups such as amino, phenyl, polyether, acrylate, siliconhydride, carboxy acid, phosphate, betaine, quarternized nitrogen and mixtures thereof.

The molecular weight of the silicone is preferably from 1,000 to 500,000, more preferably from 2,000 to 250,000 even more preferably from 5,000 to 100,000.

Preferably the silicone is an anionic functionalised silicone or an amino functionalised silicone. Most preferably the silicone is an anionic functionalised silicone.

Examples of fabric softening anionic silicones suitable for the current invention include silicones containing the following functionalities; carboxylic, sulphate, sulphonic, phosphate and/or phosphonate functionality.

Preferably anionic silicones of the current invention comprise silicones having a functionality selected from; carboxylic, sulphate, sulphonic, phosphate and/or phosphonate functionality or mixtures thereof. More preferably the anionic silicone of the present invention comprises carboxyl functionalised silicones. Most preferably the anionic silicone of the current invention is a carboxyl silicone.

For the purposes of the current invention, the anionic silicone may be in the form of the acid or the anion. For example for a carboxyl functionalised silicone, may be present as a carboxylic acid or carboxylate anion.

An example of a commercially available anionic functional material are: X22-3701E from Shin Etsu and Pecosil PS-100 from Pheonix Chemical.

When the functionalised silicone is an anionic silicone, preferably the anionic silicone has an anionic group content of at least 1 mol %, preferably at least 2 mol %.

When the functionalised silicone is an amino silicone, preferably the amino silicone has an amino group content of at least 1 mol %, preferably at least 2 mol %.

The functional group(s) on the functional silicones of the present invention, in particular anionic or amino functional groups, are preferably located in pendent positions on the silicone i.e. the composition comprises anionic silicones wherein the anionic group is located in a position other than at the end of the silicone chain. The terms 'terminal position' and 'at the end of the silicone chain' are used to indicate the terminus of the silicone chain.

When the silicones are linear in nature, there are two ends to the silicone chain. In this case the functionalised silicone preferably contains no functional groups, particularly anionic or amino groups located on a terminal position of the silicone.

When the silicones are branched in nature, the terminal position is deemed to be the two ends of the longest linear silicone chain. Preferably s no functional groups, particularly anionic or amino groups, are not located on the terminus of the longest linear silicone chain.

Preferred functionalised silicones are those that comprise the functional silicones of the present invention, in particular anionic or amino functional groups, at a mid-chain position on the silicone. Preferably the functional group(s) are located at least five Si atoms from a terminal position on the silicone. Preferably the functional groups, particularly anionic or amino groups are distributed randomly along the silicone chain.

The silicone composition of the current invention may be in the form of an emulsion or as a silicone fluid. In a preferred embodiment the silicone is in the form of a silicone emulsion.

When the silicone is in an emulsion, the particle size can be in the range from about 1 nm to 100 microns and preferably from about 10 nm to about 10 microns including microemulsions (<150 nm), standard emulsions (about 200 nm to about 500 nm) and macroemulsions (about 1 micron to about 20 microns).

The fabric softening silicones may be an emulsion or a fluid, preferably an emulsion.

Ancillary laundry compositions according to the current invention preferably comprise silicone at a level of 2 to 60 w.t % of the formulation, preferably 2.5 to 30 w.t. % of the formulation, more preferably 3 to 20 w.t. % of the formulation.

Cationic Cellulose Polymer

The ancillary laundry composition of the present invention comprises a cationic cellulose polymer. This refers to polymers having a cellulose backbone and an overall positive charge.

Cellulose is a polysaccharide with glucose as its monomer, specifically it is a straight chain polymer of D-glucopyranose units linked via beta-1,4 glycosidic bonds and is a linear, non-branched polymer.

The cationic cellulose-based polymers of the present invention have a modified cellulose backbone, modified in that additional chemical groups have been reacted with some of the free hydroxyl groups of the polysaccharide backbone to give an overall positive charge to the modified cellulose monomer unit.

A preferred class of cationic cellulose polymers suitable for this invention are those that have a cellulose backbone modified to incorporate a quaternary ammonium salt. Preferably the quaternary ammonium salt is linked to the cellulose backbone by a hydroxyethyl or hydroxypropyl group. Preferably the charged nitrogen of the quaternary ammonium salt has one or more alkyl group substituents.

Example cationic cellulose polymers are salts of hydroxyethyl cellulose reacted with trimethyl ammonium substituted epoxide, referred to in the field under the International Nomenclature for Cosmetic Ingredients as Polyquaternium 10 and is commercially available from the Amerchol Corporation, a subsidiary of The Dow Chemical Company, marketed as the Polymer LR, JR, and KG series of polymers. Other suitable types of cationic celluloses include the polymeric quaternary ammonium salts of hydroxyethyl cellulose reacted with lauryl dimethyl ammonium-substituted epoxide referred to in the field under the International Nomenclature for Cosmetic Ingredients as Polyquaternium 24. These materials are available from Amerchol Corporation marketed as Polymer LM-200.

Typical examples of preferred cationic cellulosic polymers include cocodimethylammonium hydroxypropyl oxyethyl cellulose, lauryldimethylammonium hydroxypropyl oxyethyl cellulose, stearyldimethylammonium hydroxypropyl oxyethyl cellulose, and stearyldimethylammonium hydroxyethyl cellulose; cellulose 2-hydroxyethyl 2-hydroxy 3-(trimethyl ammonio) propyl ether salt, polyquaternium-4, polyquaternium-10, polyquaternium-24 and polyquaternium-67 or mixtures thereof.

More preferably the cationic cellulosic polymer is a quaternised hydroxy ether cellulose cationic polymer. These are commonly known as polyquaternium-10. Suitable commercial cationic cellulosic polymer products for use according to the present invention are marketed by the Amerchol Corporation under the trade name UCARE.

The counterion of the cationic polymer is freely chosen from the halides: chloride, bromide, and iodide; or from hydroxide, phosphate, sulphate, hydrosulphate, ethyl sulphate, methyl sulphate, formate, and acetate.

The molecular weight of the cationic polymer is preferably greater than 20 000 g/mol, more preferably greater than 25 000 g/mol. The molecular weight is preferably less than 2 000 000 g/mol, more preferably less than 1 000 000 g/mol.

Ancillary laundry compositions according to the current invention preferably comprise cationic polymer at a level of 0.25 to 10 w.t % of the formulation, preferably 0.35 to 7.5 w.t. % of the formulation, more preferably 0.5 to 5 w.t. % of the formulation.

Ratio of Functionalised Silicone: Cationic Cellulose

In the present invention, the ratio of the functionalised fabric softening silicone to cationic cellulose polymer is 5:2 to 1:6 by weight. Preferably the ratio is 5:2 to 1:5, more preferably the ratio is 2:1 to 1:5.

Surfactant

The term surfactant covers all categories of surfactant, including: anionic, cationic, non-ionic and zwitterion surfactants. Many surfactants are traditionally used in laundry compositions: laundry detergent compositions often comprise anionic and non-ionic surfactants whereas fabric conditioning compositions often comprise cationic surfactants.

The composition of the present invention is not a traditional laundry detergent or fabric conditioning composition. The present invention preferably comprises low levels or no surfactants. Any surfactant present is preferably for the purpose of emulsifying the silicone ant not for detergency or softening.

The composition of the present invention comprises less than 5 w.t. % surfactant, preferably less than 2 w.t. % surfactant, more preferably less than 1 w.t. % surfactant and most preferably less than 0.85 w.t. % surfactant. Composition can be completely free of non-emulsified surfactant (ie surfactant not-used to emulsify the droplets of benefit agent).

Surfactants used to emulsify benefit agents such as silicones may be included at a level higher than some of the preferred embodiments above when high levels of benefit agents are used. The ranges above are intended for surfactants present for purposes other than emulsifying the benefit agent, such as for cleaning and softening.

In other words, the compositions may comprise 0 to 5 w.t. % surfactant, preferably, the composition of the present invention comprises 0 to 2 w.t. % surfactant, more preferably, 0 to 1 w.t. % surfactant, most preferably 0 to 0.85 w.t. %. The composition can be completely free of non-emulsified surfactant (ie surfactant not-used to emulsify the droplets of benefit agents).

Perfumes

The ancillary laundry compositions of the present invention preferably comprises a perfume composition. Perfume may be provided either as a free oil and/or in a microcapsule.

The ancillary laundry composition of the present invention may comprise one or more perfume compositions. The perfume compositions may be in the form of a mixture or free perfumes compositions, a mixture of encapsulated perfume compositions or a mixture of encapsulated and free oil perfume compositions.

Useful perfume components may include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavouring, and/or aromatizing consumer products.

Free oil perfumes and fragrances may be added to the ancillary laundry composition. These may be to scent the ancillary laundry composition, to provide scent in the washing process or to provide scent to the textiles after the wash.

Particularly preferred perfume components are blooming perfume components and substantive perfume components. Blooming perfume components are defined by a boiling point less than 250° C. and a Log P greater than 2.5. Substantive perfume components are defined by a boiling point greater than 250° C. and a Log P greater than 2.5. Preferably a perfume composition will comprise a mixture of blooming and substantive perfume components. The perfume composition may comprise other perfume components.

It is commonplace for a plurality of perfume components to be present in a free oil perfume composition. In the compositions for use in the present invention it is envisaged that there will be three or more, preferably four or more, more preferably five or more, most preferably six or more different perfume components. An upper limit of 300 perfume ingredients may be applied.

Free perfume may preferably be present in an amount from 0.01 to 20% by weight, more preferably from 0.05 to 10% by weight, even more preferably from 0.1 to 5.0%, most preferably from 0.15 to 5.0% by weight, based on the total weight of the composition.

When perfume components are in a microcapsule, suitable encapsulating material, may comprise, but are not limited to; aminoplasts, proteins, polyurethanes, polyacrylates, polymethacrylates, polysaccharides, polyamides, polyolefins, gums, silicones, lipids, modified cellulose, polyphosphate, polystyrene, polyesters or combinations thereof.

Perfume components contained in a microcapsule may comprise odiferous materials and/or pro-fragrance materials.

Particularly preferred perfume components contained in a microcapsule are blooming perfume components and substantive perfume components. Blooming perfume components are defined by a boiling point less than 250° C. and a Log P greater than 2.5. Substantive perfume components are defined by a boiling point greater than 250° C. and a Log P greater than 2.5. Preferably a perfume composition will comprise a mixture of blooming and substantive perfume components. The perfume composition may comprise other perfume components.

It is commonplace for a plurality of perfume components to be present in a microcapsule. In the compositions for use in the present invention it is envisaged that there will be three or more, preferably four or more, more preferably five or more, most preferably six or more different perfume components in a microcapsule. An upper limit of 300 perfume ingredients may be applied.

Encapsulated perfume may preferably be present in an amount from 0.01 to 20% by weight, more preferably from 0.05 to 10% by weight, even more preferably from 0.1 to 5.0%, most preferably from 0.15 to 5.0% by weight, based on the total weight of the composition.

If the liquid ancillary composition comprises a microcapsules, a structurant may be required, non-limiting examples of suitable structurants include: pectine, alginate, arabinogalactan, carageenan, gellan gum, xanthum gum, guar gum, acrylates/acrylic polymers, water-swellable clays, fumed silicas, acrylate/aminoacrylate copolymers, and mixtures thereof. Preferred dispersants herein include those selected from the group consisting of acrylate/acrylic polymers, gellan gum, fumed silicas, acrylate/aminoacrylate copolymers, water-swellable clays, and mixtures thereof. Preferably a structurant is selected from acrylate/acrylic polymers, gellan gum, fumed silicas, acrylate/aminoacrylate copolymers, water-swellable clays, and mixtures thereof.

When present, a structurant is preferably present in an amount of 0.001-10 w.t. % percent, preferably from 0.005-5 w.t. %, more preferably 0.01-1 w.t. %.

Rheology Modifier

In some embodiments of the present invention, the ancillary laundry compositions of the present invention may comprise rheology modifiers. These may be inorganic or organic, polymeric or non polymeric. A preferred type of rheology modifiers are salts.

Viscosity

The composition of the present invention preferably has a viscosity of less than 15000 Pa·s. Preferably the present invention has a viscosity of more than 400 Pa·s. Viscosity measurements were carried out at 25° C., using a 4 cm diameter 2° cone and plate geometry on a DHR-2 rheometer ex. TA instruments.

In detail, all measurements were conducted using a TA-Instruments DHR-2 rheometer with a 4 cm diameter 2 degree angle cone and plate measuring system. The lower Peltier plate was used to control the temperature of the measurement to 25° C. The measurement protocol was a 'flow curve' where the applied shear stress is varied logarithmically from 0.01 Pa to 400 Pa with 10 measurement points per decade of stress. At each stress the shear strain rate is measured over the last 5 seconds of the 10 second period over which the stress is applied with the viscosity at that stress being calculated as the quotient of the shear stress and shear rate.

For those systems which exhibit a low shear viscosity plateau over large shear stress ranges, to at least 1 Pa, the characteristic viscosity is taken as being the viscosity at a shear stress of 0.3 Pa. For those systems where the viscosity response is shear thinning from low shear stress the characteristic viscosity is taken as being the viscosity at a shear rate of 21 s-1.

Other Optional Ingredients

The ancillary laundry composition of the present invention may comprise other ingredients suitable for laundry compositions which will be known to the person skilled in the art. Among such materials there may be mentioned: antifoams, encapsulated perfumes and fragrances, insect repellents, shading or hueing dyes, preservatives (e.g. bactericides), enzymes, dye transfer inhibitors, pH buffering agents, perfume carriers, hydrotropes, anti-redeposition agents, soil-release agents, softening agents, polyelectrolytes, anti-shrinking agents, anti-wrinkle agents, anti-oxidants, dyes, colorants, fluorescent agents, sunscreens, anti-corrosion agents, anti-static agents, sequestrants and ironing aids. The products of the invention may contain pearlisers and/or opacifiers. A preferred sequestrant is HEDP, an abbreviation for Etidronic acid or 1-hydroxyethane 1,1-diphosphonic acid.

Method of Using the Ancillary Laundry Composition

In a preferred embodiment of the present invention, the ancillary laundry composition of the present invention is used in addition to a laundry detergent.

One aspect of the present invention is a method of laundering fabrics, wherein the fabrics are treated with a laundry detergent composition and an ancillary laundry composition comprising:

2-60 w.t. % functionalised fabric softening silicone;

Less than 5 w.t. % surfactant;

0.25-10 w.t. % cationic cellulose polymer

Water

Wherein the functionalised fabric softening polymer and cationic cellulose polymer are present in a ratio of 5:2 to 1:6 by weight.

In a preferred embodiment the ancillary laundry composition is added to the laundry process in a volume of 2-100 ml, more preferably a volume of 2-50 ml, even more preferably a volume of ml 2-30 ml, most preferably 2-20 ml.

The compositions of the present invention are preferably used in conjunction with a main wash or rinse added laundry composition.

The ancillary product may be added to the drum of draw of a washing machine either with a the laundry detergent, after a detergent or before a laundry detergent. Most preferably the ancillary product is added to the drum or draw after the detergent.

Use of the Ancillary Laundry Composition

In one aspect of the present invention, the ancillary laundry composition of the present invention is used to enhance the benefits provided by silicone to a fabric The benefits may be defined as: softness, elastic recovery, drape, shape, anti-creasing, wrinkle prevention, abrasive damage.

Preferably the benefit is defined as softness. i.e. use of the ancillary composition to enhance softening.

Example 1

Softening Improvements

Method of Preparing Example Laundry Formulations:

Water and hydrotropes were mixed together at ambient temperature for 2-3 minutes at a shear rate of 150 rpm using a Janke & Kunkel IKA RW20 overhead mixer. Salts and alkalis were added and mixed for 5 minutes prior to addition of surfactants and fatty acid. The mixture was exothermic and allowed to cool to <30° C. The deposition polymer[2] (when present), silicone emulsion[1] (when present) and any remaining components such as perfume, preservatives and dyes are added.

Method of Producing Example Serum:

Demineralised water was added to the silicone emulsion[1] and mixed for 15 mins at 250 rpm using a Janke & Kunkel IKA RW20 overhead mixer. The solid deposition polymer[2] was added slowly over the top and mix for further 20 mins increasing the rotor speed to effect visible bulk mixing.

TABLE 1

Example Compositions

| Ingredient | Laundry detergent with silicone (w.t. %) | Laundry detergent without silicone (w.t. %) | Ancillary Laundry Composition (w.t. %) |
|---|---|---|---|
| Glycerol | 3.5 | 3.5 | — |
| TEA | 1.25 | 1.25 | — |
| Citric acid | 1.0 | 1.0 | — |
| Neodol 25-7 | 4.75 | 4.75 | — |
| LAS acid | 4.0 | 4.0 | — |

TABLE 1-continued

Example Compositions

| Ingredient | Laundry detergent with silicone (w.t. %) | Laundry detergent without silicone (w.t. %) | Ancillary Laundry Composition (w.t. %) |
|---|---|---|---|
| Fatty Acid | 0.7 | 0.7 | — |
| Lauryl ether sulphate - Sodium salt | 2.0 | 2.0 | — |
| Silicone[1] | 0.6 | 0 | 5 |
| Deposition polymer[2] | 0.3 | 0 | 2 |
| NaOH | to pH 8-8.5 | to pH 8-8.5 | to pH 7-8 |
| Minors | <5 | <5 | <5 |
| Water | to 100 | to 100 | to 100 |

Silicone[1] - Silicone added as a 30% emulsion ex. Wacker Silicone. The silicone comprised a carboxy group in a mid-chain pendent position.
Deposition polymer[2] - Ucare ™ polymer LR400 ex. Dow Comparison of Formulations:

A wash cycle was carried out using 6 (20 cm×20 cm) pieces of terry towelling and a polycotton ballast. The total wash load was 2.0 kg. The towelling was mixed with the ballast fabric in a random order before adding into a Miele front loading washing machine.

Detergent was added as follows:

Wash A: 100 g Laundry detergent with silicone

Wash 1: 100 g Laundry detergent without silicone and 10 g Ancillary Laundry Composition to the wash drawer The machine was programed to a standard 40° C. cotton cycle. The towelling swatches were line dried between wash cycles. 5 wash cycles were performed.

The towels were measured for softness using a Phabrometer® ex. Nu Cybertek, Inc.

TABLE 2

Softness measurements results

| | Average softness | Standard deviation |
|---|---|---|
| Pre-wash sample | 9.887 | 0.272 |
| Wash A | 9.654 | 0.155 |
| Wash 1 | 9.193 | 0.220 |

Despite having slightly lower levels of silicone and deposition polymer in Wash 1, the fabric is significantly softer.

Example 2

Assessing Polymer Stability

Assessing Stability of Various Cationic Polymers and Carboxy Functionalised Silicone Demineralised water was added to the carboxy functionalised silicone[1] and was mixed for 15 minutes. The solid cationic polymer was added slowly to the mix and mixed for a further 20 minutes, with increasing speed. The mix was poured into a glass jar and initial visual stability was assessed. Instability is indicated by separation of the mixture.

For the premix composition, the cationic polymer was prepared as a 1% pre-mix with water, this was used in place of the demineralised in the method above.

TABLE 3

| Polymer stability | | | | | | | | |
|---|---|---|---|---|---|---|---|---|
| | Ratio of Silicone:Polymer | | | | | | | |
| | 1:2 | 1:3 | 1:4 | 1:5 | 1:7.5 | 1:10 | 1:13 | 1:13 premix |
| Cationic cellulose[2] | Stable | Stable | Stable | Stable | Unstable | Unstable | Unstable | Unstable |
| Cationic guar[3] | Unstable | Unstable | Unstable | — | — | — | — | — |
| Cationic guar[4] | Unstable | Unstable | Unstable | Unstable | — | — | Unstable | Unstable |
| Cationic guar[5] | Unstable | Unstable | Stable/ Unstable | — | — | — | — | — |

Silicone[1] - Silicone added as a 30% emulsion ex. Wacker Silicone. The silicone comprised a carboxy group in a mid-chain pendent position.
Cationic cellulose[2] - Ucare ™ polymer LR400 ex. Dow
Cationic guar[3] - N-Hance BF17 ex. Ashland
Cationic guar[4] - N-Hance CCG45 ex. Ashland
Cationic guar[5] - Galactosol SP813S ex. Hercules

Example 2

Assessing Silicone

Assessing Stability of Cationic Cellulose Polymer and Various Fabric Softening Silicones Samples were prepared as in Example 1 with different types of silicones and cellulose cationic polymer. Visual stability was assessed over time.

TABLE 4

| Silicone stability | | | | | | |
|---|---|---|---|---|---|---|
| | Ratio of Silicone:Polymer | Initial | 3 days | 1 week | 3 weeks at 45° C. | 6 weeks at 45° C. |
| Carboxy functionalised silicone | 5:2 | yes | yes | yes | yes | yes |
| | 2:1 | yes | yes | yes | | |
| | 1:1 | yes | yes | yes | | |
| Amino functionalised silicone | 5:2 | ok | ok | ok | no | — |
| | 2:1 | yes | yes | yes | yes | yes |
| Non-functionalised silicone | 5:2 | yes | ok | no | — | — |
| | 2:1 | yes | yes | yes | no | — |

Carboxy functionalised silicone - A silicone comprising a carboxy group in a mid-chain pendent position. ex. Wacker Silicone
Amino functionalised silicone - Finish CT 208E (amino OH PDMS emulsion) ex. Wacker
Non functionalised silicone - Polydimethylsiloxane (PDMS)

Stability of the mix is only achieved with a mix of a functionalised silicone and cationic cellulose polymer between the ratios of 5:2 to 1:6 by weight.

The invention claimed is:

1. An ancillary laundry composition comprising:

a) 2 to 20 w.t. % of an anionic functionalised fabric softening silicone;

b) 0 to 0.85 w.t. % of a surfactant;

c) 0.35 to 10 w.t. % of a cationic cellulose polymer having a cellulose backbone modified to incorporate a quaternary ammonium salt; and d) water;

wherein the anionic functionalised fabric softening silicone and the cationic cellulose polymer are present in a ratio of 5:2 to 1:6 by weight.

2. The ancillary laundry composition according to claim 1, wherein the quaternary ammonium salt is linked to the cellulose backbone by a hydroxyethyl or hydroxypropyl group.

3. The ancillary laundry composition according to claim 1, wherein the anionic functionalised fabric softening silicone comprises a carboxy group in a pendent position.

4. The ancillary laundry composition according to claim 1, wherein the anionic functionalised fabric softening silicone comprises a carboxy group in a mid-chain position.

5. The ancillary laundry composition according to claim 1, wherein the anionic functionalised fabric softening silicone is an emulsion.

6. The ancillary laundry composition according to claim 1, wherein the composition comprises 2.5-20 w.t. % silicone.

7. The ancillary laundry composition according to claim 1, wherein the composition comprises perfume as a free oil and/or in a microcapsule.

8. The ancillary laundry composition according to claim 1, wherein the composition comprises a rheology modifier.

9. The ancillary laundry composition according to claim 1, wherein the viscosity is less than 15000 Pa·s.

10. A method of laundering fabrics, wherein the fabrics are treated with a laundry detergent composition and an ancillary laundry composition comprising:

a) 2 to 20 w.t. % of an anionic functionalised fabric softening silicone;

b) 0 to 0.85 w.t. % of a surfactant;

c) 0.35 to 10 w.t. % of a cationic cellulose polymer having a cellulose backbone modified to incorporate a quaternary ammonium; and d) water;

wherein the anionic functionalised fabric softening silicone and the cationic cellulose polymer are present in a ratio of 5:2 to 1:6 by weight.

11. The method according to claim 10 wherein the ancillary laundry composition enhances softening benefits provided by silicone to a fabric.

* * * * *